US007585133B2

(12) United States Patent
Jones

(10) Patent No.: US 7,585,133 B2
(45) Date of Patent: Sep. 8, 2009

(54) METHOD AND APPARATUS FOR DRIVING A PILE INTO UNDERWATER SUBSTRATES

(75) Inventor: Clive Jones, Dorset (GB)

(73) Assignee: Fast Frames (UK) Limited (GB)

( * ) Notice: Subject to any disclaimer, the term of this patent is extended or adjusted under 35 U.S.C. 154(b) by 116 days.

(21) Appl. No.: 11/910,965

(22) PCT Filed: Apr. 4, 2006

(86) PCT No.: PCT/GB2006/001239

§ 371 (c)(1),
(2), (4) Date: Dec. 12, 2007

(87) PCT Pub. No.: WO2006/109018

PCT Pub. Date: Oct. 19, 2006

(65) Prior Publication Data

US 2009/0129870 A1 May 21, 2009

(30) Foreign Application Priority Data

Apr. 14, 2005 (GB) ..... 0507549.4

(51) Int. Cl.
*E02D 7/02* (2006.01)

(52) U.S. Cl. ..... 405/228; 406/232

(58) Field of Classification Search ..... 405/228, 405/227, 231, 232, 224

See application file for complete search history.

(56) References Cited

U.S. PATENT DOCUMENTS

| | | | | | |
|---|---|---|---|---|---|
| 4,051,685 | A | * | 10/1977 | Jansz | 405/228 |
| 4,063,599 | A | * | 12/1977 | Jansz | 405/228 |
| 4,109,475 | A | * | 8/1978 | Schnell | 405/228 |
| 4,817,734 | A | | 4/1989 | Kuehn | |
| 5,915,883 | A | * | 6/1999 | Kuehn | 405/228 |
| 6,325,158 | B1 | | 12/2001 | Ranges et al. | |
| 6,354,767 | B1 | | 3/2002 | Jones | |
| 6,749,371 | B2 | * | 6/2004 | Jones | 405/228 |
| 6,994,493 | B2 | * | 2/2006 | Jones | 405/231 |
| 2003/0077127 | A1 | * | 4/2003 | Jones | 405/253 |

FOREIGN PATENT DOCUMENTS

| | | | |
|---|---|---|---|
| WO | WO00/14338 | | 3/2000 |
| WO | WO 00/23660 | * | 4/2000 |
| WO | WO 2009/024739 | * | 2/2009 |

* cited by examiner

*Primary Examiner*—Frederick L Lagman
(74) *Attorney, Agent, or Firm*—Townsend and Townsend and Crew LLP

(57) ABSTRACT

Apparatus (10) for driving a pile into an underwater substrate, comprises a pile guide (11) having a base frame (12) with a guide member (14) mounted thereon, the guide member configured to guide a pile as it is driven into a substrate when the base frame is resting thereon. The base frame (12) defines a substantially rectangular platform (16) for carrying a device for driving a pile into a substrate, and a power supply for supplying power to drive the device, during deployment. Once deployed, a pile (50) is positioned in the guide member (14) and the device (2) is lifted onto the pile (50). The power supply (30) drives the device (2) as the pile (50) is driven into the substrate.

29 Claims, 8 Drawing Sheets

METHOD AND APPARATUS FOR DRIVING A PILE INTO UNDERWATER SUBSTRATES

FIELD OF THE INVENTION

The present invention relates to a method and apparatus for driving a pile into an underwater substrate, such as the seabed.

BACKGROUND ART

It is known to provide pile guides for underwater piling, see for example, Sea Steel Ltd's range of pile guides as described in WO99/11872 (Fast Frame pile guide), WO01/92645 (Finned Frame/Follower pile guide) and WO03/074795 (Orientation Control pile guide). With such pile guides, piles may be driven into the seabed using hydraulic hammers, such as the IHC Hydrohammers supplied by Dutch Company IHC Hydrohammer BV. However, to date it has not been possible to operate the hammers effectively or economically below about 500 m below sea level for several reasons. If the power supply for the hydraulic hammer is situated at the surface, the length of hydraulic (umbilical) hose required to reach the seabed becomes problematic due to weight and friction losses and required winch capacity for such a hose. If the power supply for the hydraulic hammer is situated at or near the seabed, different problems arise. For example, providing a "girdle" type power supply coupled to the hammer produces an assemblage which is—in practical terms—too large to pass through existing pile guides. Such a power supply is known from U.S. Pat. No. 4,817,734. Also, providing a "container" type power supply which sits independently on the seabed involves additional work during initial deployment, when transferring at seabed, and during subsequent recovery.

The present applicant(s) have sought to address the problems of pile driving at depths in excess of 500 m below sea level, and propose a novel solution which is applicable to underwater pile driving at any depth.

DISCLOSURE OF INVENTION

In accordance with a first aspect of the present invention, there is provided apparatus for driving a pile into a seabed, comprising: a pile guide comprising a base frame and a guide member mounted on the base frame, the guide member being configured to guide a pile as it is driven into a substrate when the base frame is resting thereon; a device for driving a pile into a seabed; and a power supply for supplying power to drive the device; characterised in that the base frame of the pile guide defines a platform configured to carry the device and power supply when the pile guide is being moved into position for pile driving.

The present invention uses a pile guide not only to support and/or align piles during pile driving, but also as a single platform assembly to carry essential equipment required to perform the task. In this way, the present invention makes it possible to reduce or even eliminate the conventional requirement to retrieve the device (and peripherals) to the surface between installations. It also makes it possible to deploy the pile guide, the device and the power supply as one assemblage.

The device may be a hydraulic hammer for driving piles into the substrate through repeated impacts. Alternatively, the device may be a suction pump for driving suction piles or caissons into the substrate through a pressure differential. The platform may include a mount (e.g. a post) for supporting the device when coupled thereto. The mount may be configured to support the device in a predetermined orientation when coupled thereto.

The power supply may supply mechanical or electrical power (e.g. to drive a hydraulic power pack) or may even supply hydraulic power direct to the device (e.g. hydraulic hammer or suction pump). Hydraulic power may be supplied through a hose during pile driving. The hose need only have a length sufficient to communicate between the power supply and the device during pile driving. The device may include a protuberant arm for guiding the hose to one lateral side of the device.

The power supply may be part of a remotely operated vehicle (e.g. ROV), or even a work remotely operated vehicle (WROV), detachably mounted on the platform of the pile guide. In this way, the remotely operated vehicle may be used to carry out inspections in between pile driving. When mounted on the platform, the remotely operated vehicle may be configured to provide thrust for control of pile guide orientation during deployment. The platform of the pile guide may include a docking station for repeated attachment/detachment of the remotely operated vehicle thereto. The docking station may have an interface panel configured to receive power from the remotely operated vehicle when attached to the docking station. The remotely operated vehicle and interface panel may include mating connectors (e.g. so-called "hotstab and receptacle") for communication between the power supply and the interface panel. The connectors may matingly engage automatically as the remotely operated vehicle attaches to the docking station.

In accordance with a second aspect of the present invention, there is provided a method of driving a pile into an underwater substrate (e.g. seabed), comprising: providing apparatus as defined according to the first aspect of the present invention; positioning the apparatus on the underwater substrate; positioning a pile in the pile guide member; moving the device from the platform of the base frame to engage the pile; and driving the pile into the substrate by using the power supply to power the device.

The method may further comprise storing the driving device on the platform of the base frame after the pile has been driven into the substrate and before a new pile is driven into the substrate. The device may be moved between its rest position (on the platform of the base frame) and its operational position (on a pile in the pile guide member) by a crane above water level. The crane may also be used to raise and lower the pile guide and to position the pile in the pile guide member. The device may be a hydraulic hammer or a suction pump, with the piles respectively being regular piles or suction piles.

The power supply may be part of a remotely operated vehicle (e.g. ROV), or even a work remotely operated vehicle (WROV), detachably mounted on the platform of the pile guide. The method may further comprise detaching the remotely operated vehicle from the platform of the base frame to perform a task associated with pile driving. The task may be selected from the group consisting of: inspecting the pile in the pile guide member; releasing fastenings attaching the device to the base frame; coupling the device to lifting means (e.g. surface crane); inspecting engagement between the device and the pile; inspecting the pile once driven into the substrate; and coupling the pile guide to lifting means (e.g. surface crane). The platform of the base frame may include a docking station for re-attachment of the remotely operated vehicle to the platform once the or each task is completed. The docking station may have an interface panel configured to receive power from the remotely operated vehicle when attached to the docking station. The remotely operated vehicle and interface panel may include mating connectors for communication of power from the former to the latter.

Mating engagement of the connectors may be established by re-attaching the remotely operated vehicle to the platform via the docking station.

The method may further comprise using the remotely operated vehicle to provide thrust for control of pile guide orientation and position during deployment.

The method may further comprise controlling orientation of the device relative to the pile in the pile guide member when engaging the pile. Such control may help to avoid any hydraulic hose (supplying hydraulic power to the device) from becoming tangled around the pile or pile guide member.

BRIEF DESCRIPTION OF DRAWINGS

Embodiments of the invention will now be described by way of example, with reference to the following drawings.

DESCRIPTION OF EMBODIMENT OF INVENTION

Figure 7:
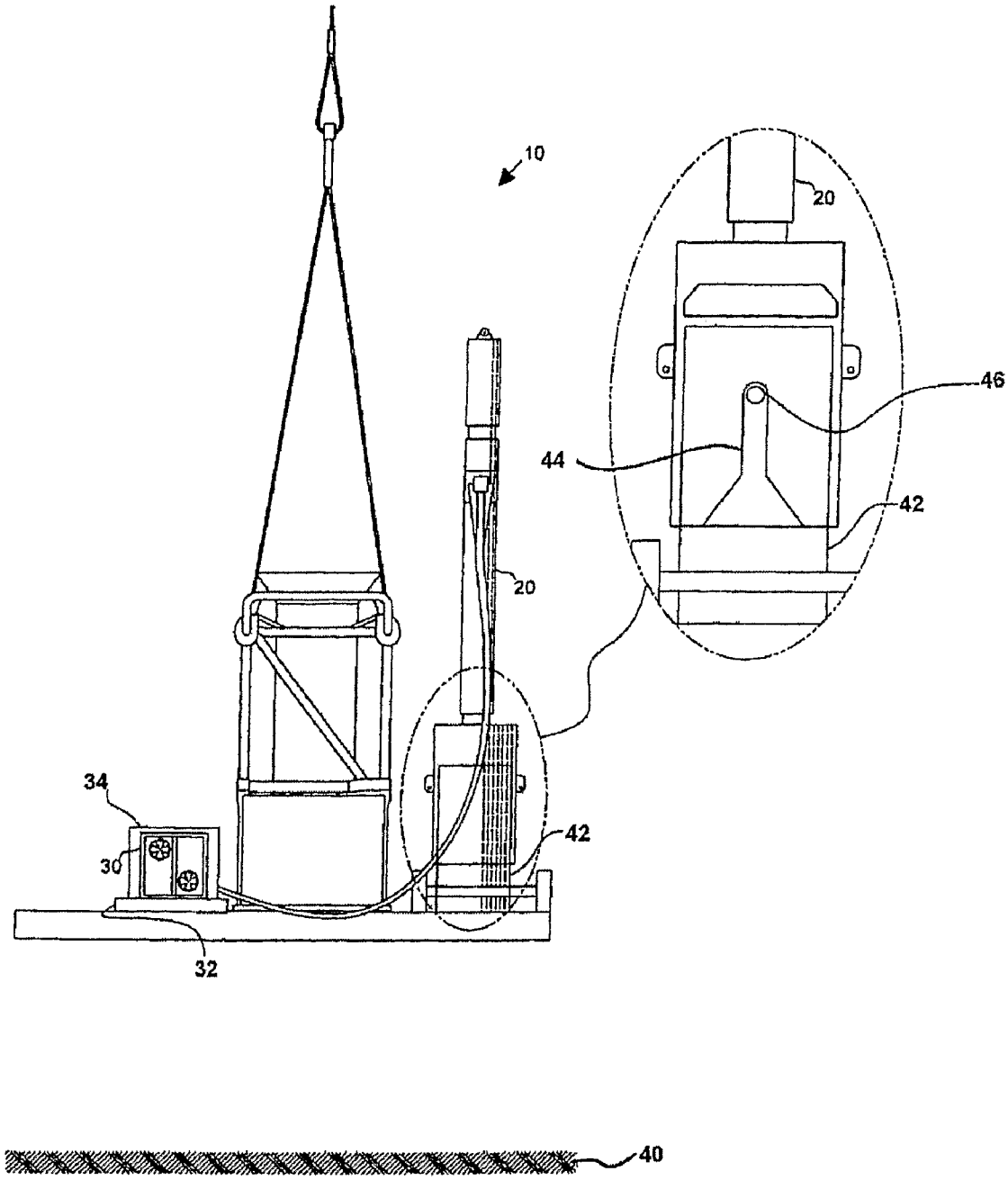
FIG. 7 shows a front elevation of the apparatus of FIG. 1, when being deployed.
Figure 8:
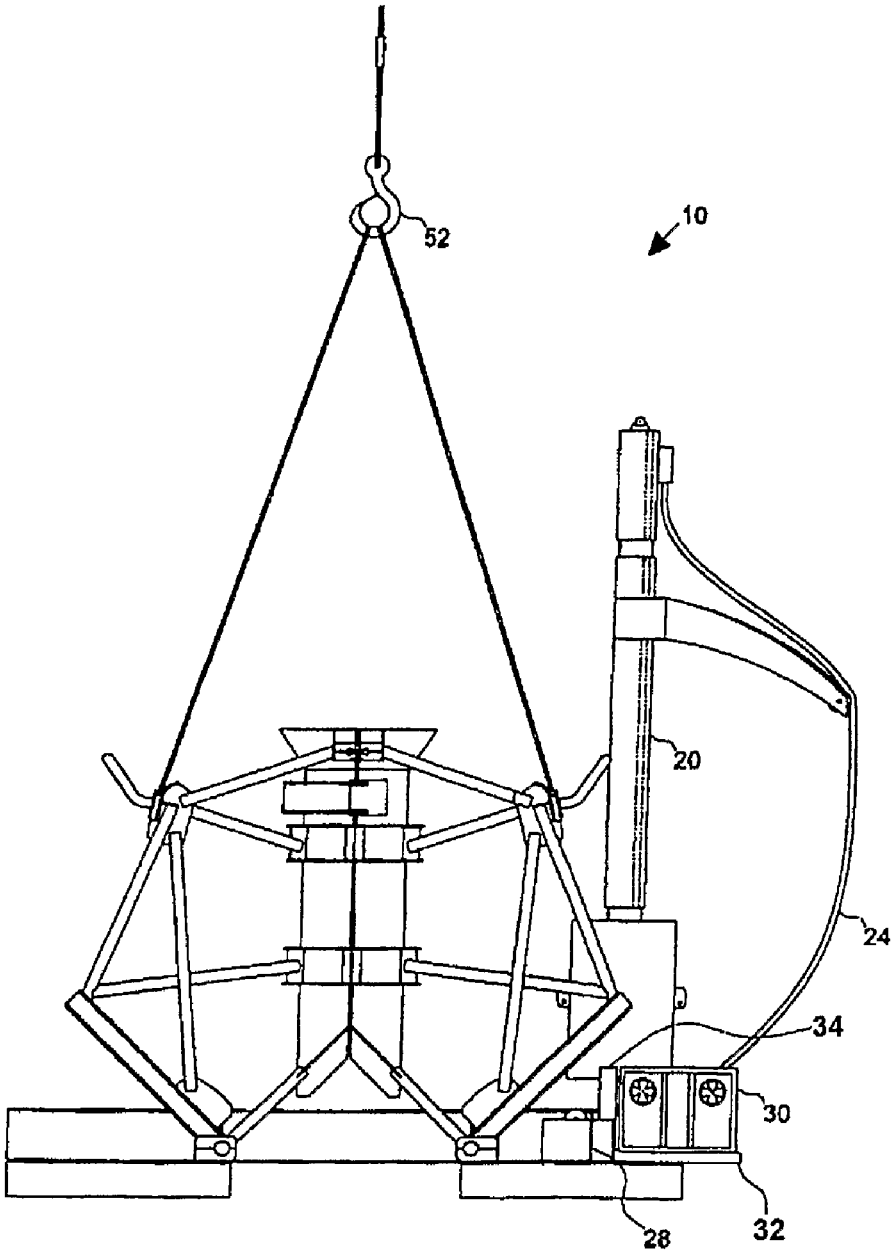
FIG. 8 shows a side elevation of the apparatus of FIG. 1, when being deployed.
Figure 8:
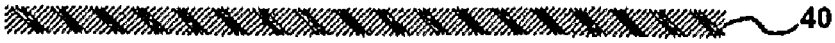

FIGS. 1-4 show apparatus (10) embodying the present invention, and comprising a pile guide (11), a hydraulic device (20) in the form of a hammer, and a power supply (30) in the form of a work remotely operated vehicle (WROV). The pile guide (11) has a base frame (12) and a guide member (14) mounted on the base frame (12) for guiding a pile as it is driven into a substrate. Throughout the figures, the pile guide (11) illustrated is as described in WO99/11872, to which reference should now be made for an explanation of its principles of operation. The base frame (12) defines a substantially rectangular platform (16) for carrying the hydraulic hammer (20) and WROV (30) when the pile guide (11) is being moved into position, e.g. on seabed (40). FIGS. 7 and 8 show the hydraulic hammer (20) and WROV (30) being carried on the platform (16).

The hydraulic hammer (20), such as the IHC Hydrohammer supplied by IHC Hydrohammer BV, is initially attached to a storage post (42) projecting from the platform (16) of pile guide (11). The hydraulic hammer (20) includes a lift loop (22) which is engageable by a crane hook when the time comes to lift the hydraulic hammer (20) relative to the pile guide (11). The hydraulic hammer (20) has hose (24) for supplying hydraulic fluid thereto. The hose (24) is attached to arm (26) which projects from hydraulic hammer (20) to avoid fouling/damage during pile driving. The hose (24) is coupled to spooling device (28) which takes up slack in the hose (24) during pile driving. The hammer (20) has a profile (44) for engaging a locating dowel (46) on the pile storage post (42) in such a way that the arm (26) is aligned in a predetermined orientation relative the pile guide (11).

The WROV (30) is initially engaged and mounted in a docking (32) on the platform (16) of the pile guide (11). The WROV (30) is mounted in such a way that it is able to provide a thrust for controlling pile guide (11) orientation as it is being deployed. The WROV (30) may be released from the docking station to enable inspections to be carried out before and after pile driving operations. The docking station (32) includes an interface panel (34), with the interface panel (34) and WROV (30) having mating connectors which engage automatically when the WROV (30) docks in the docking station (32). When mounted in the docking station, the WROV (30) will supply the hydraulic power to drive through hose (24) the hydraulic hammer (20).

A typical subsea pile installation procedure will now be described to illustrate use of the apparatus (10) embodying the present invention.

(1) The apparatus (10) is deployed to the seabed (40), with the hydraulic hammer (20) and WROV (30) attached to the platform (16) of pile guide (11) as described above. The WROV (30) is controlled through an umbilical which is paid out from the surface as the apparatus (10) is deployed.

(2) At the seabed (40), the orientation of the pile guide (11) relative to the seabed (40) is ascertained and adjusted if required, using thrust provided by the WROV (30).

(3) Once the pile guide (11) is settled on the seabed (40), a first pile (50) is deployed into the guide member (14) of the pile guide (11). The orientation or "heading" of the pile (50) relative to the pile guide (11) is controlled (e.g. using the technique described in WO03/074795) so that padeye and tether (56) is aligned in a predetermined way. A pile lift tool (52) may be "wet" stored on the pile guide (11) ready to be used again once the pile guide (11) has been moved to a new location, and a new pile (50') is required to be deployed.

(4) The WROV (30) disengages the docking station (32) and is used to inspect the positioning of the pile (50) in the guide member (14). If all is satisfactory, the WROV (30) is used to assist release the hydraulic hammer (20) from the storage post (42) on the platform (16) and to attach crane hook (52) to lift loop (22).

(5) The hydraulic hammer (20) is lifted onto pile (50), with the profile (44) engaging a locating dowel (not shown) on the pile (50) to ensure that the hydraulic hammer achieves a predetermined orientation relative to the pile guide (11). In this way, arm (26) points towards spooling device (28). The WROV (30) is used to connect the hose (24)—together with any control lines—into the spooling device (28) via mating connectors e.g. hotstabs (not shown).

(6) The WROV (30) is returned to the docking station so that it may supply hydraulic fluid to the hammer (20) through hose (24).

(7) The hydraulic hammer (20) is used to drive the pile (50) into the seabed (40).

(8) When driving is complete (as determined by an inspection from the WROV (30) or secondary WROV used in support), the hammer (20) is lifted and stored back on the platform (16) of the pile guide (11) without disconnecting hose (24).

(9) The pile guide (11) is lifted clear of the seabed (40)—but there is no need for it to be raised to the surface unless piling in the area is complete—and moved to an adjacent site for the next piling operation. The WROV (30) is used to monitor lifting of the pile guide (11), and is returned to the docking station to enable step (2) to be repeated.

(10) The crane used to lift and reposition the pile guide (11) is subsequently used to retrieve the pile lift tool temporarily stored on the pile guide (11) so that a second pile (50') may be deployed into the guide member (14).

(11) Steps (4) to (9) may then be repeated.

On completion of the last pile, the hammer (20) is retrieved to the surface separately from the pile guide (11) with WROV (30) mounted in the docking station.

Figure 1:
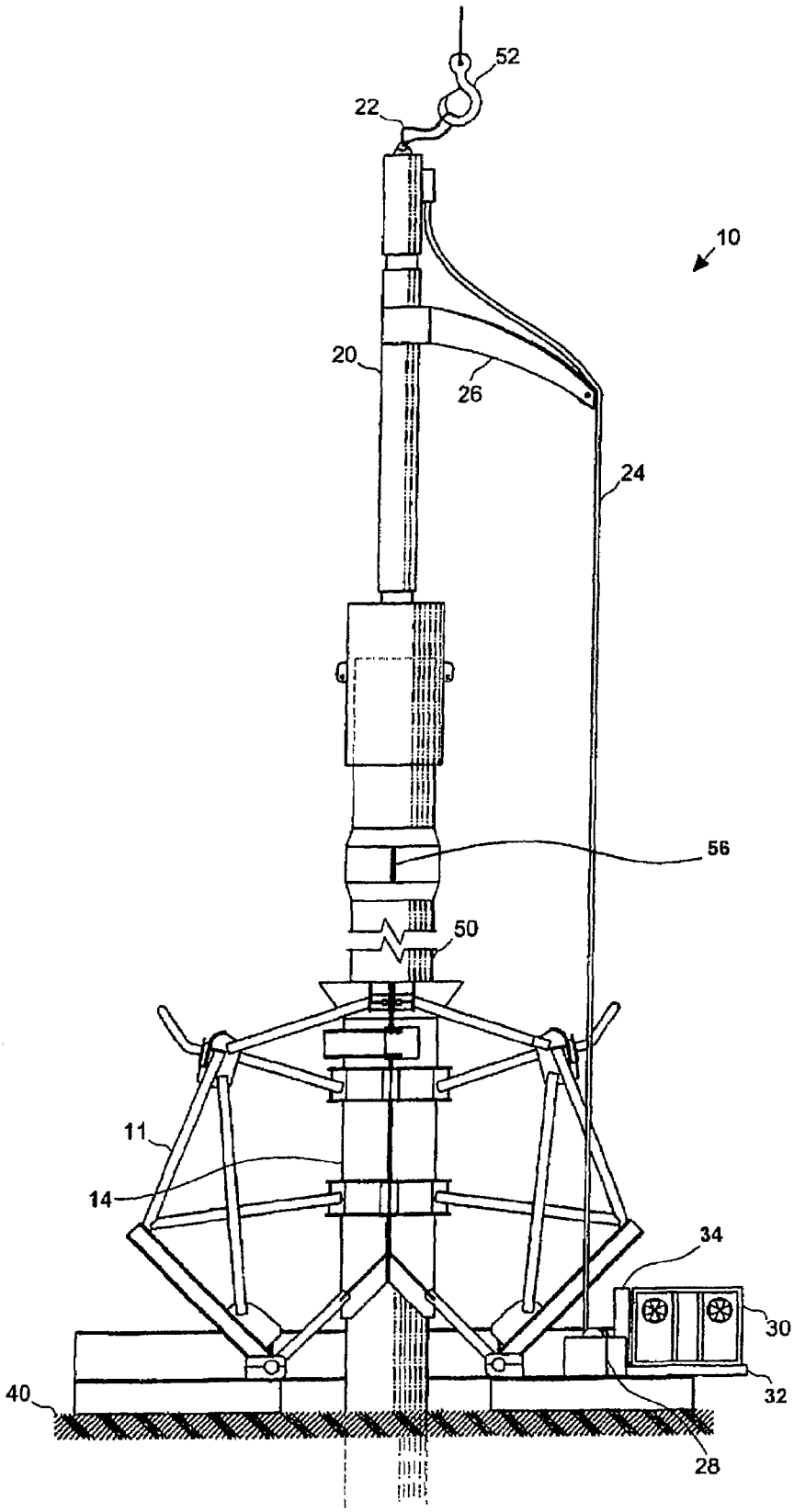
FIG. 1 shows a side elevation of apparatus embodying the present invention, when arranged to start driving a pile into a substrate.
Figure 2:
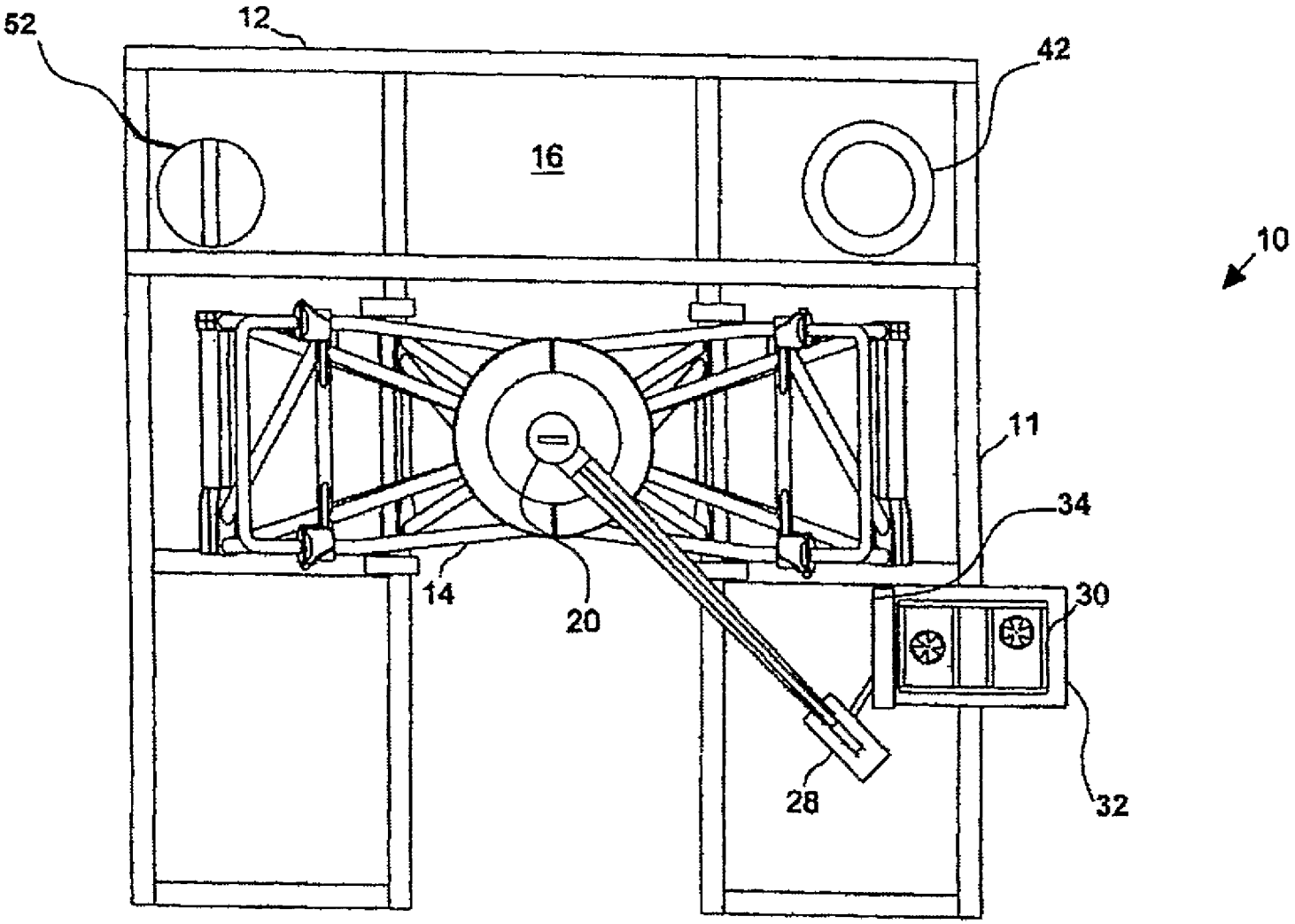
FIG. 2 is a plan view of the apparatus of FIG. 1, when arranged to start driving the pile into the substrate.
Figure 3:
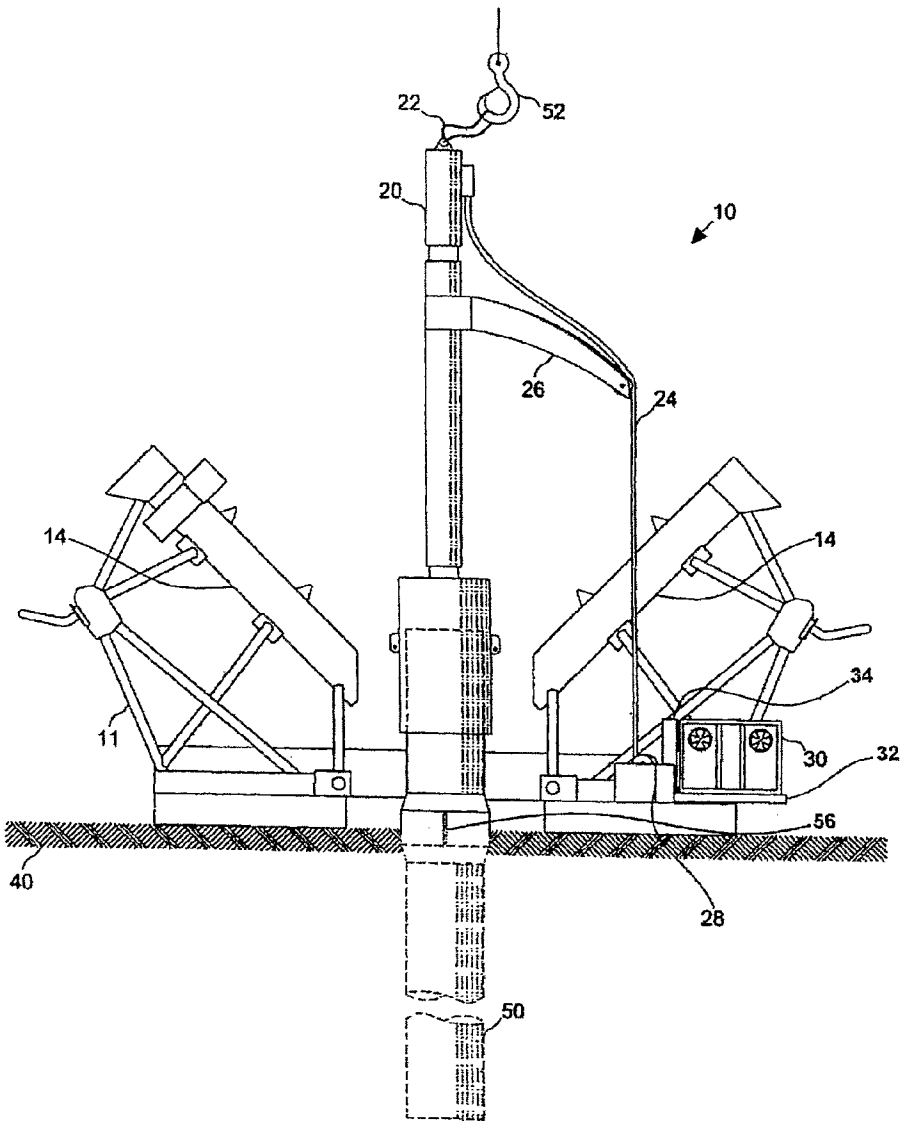
FIG. 3 is a side elevation of the apparatus of FIG. 1, when the pile has been driven into the substrate.
Figure 4:
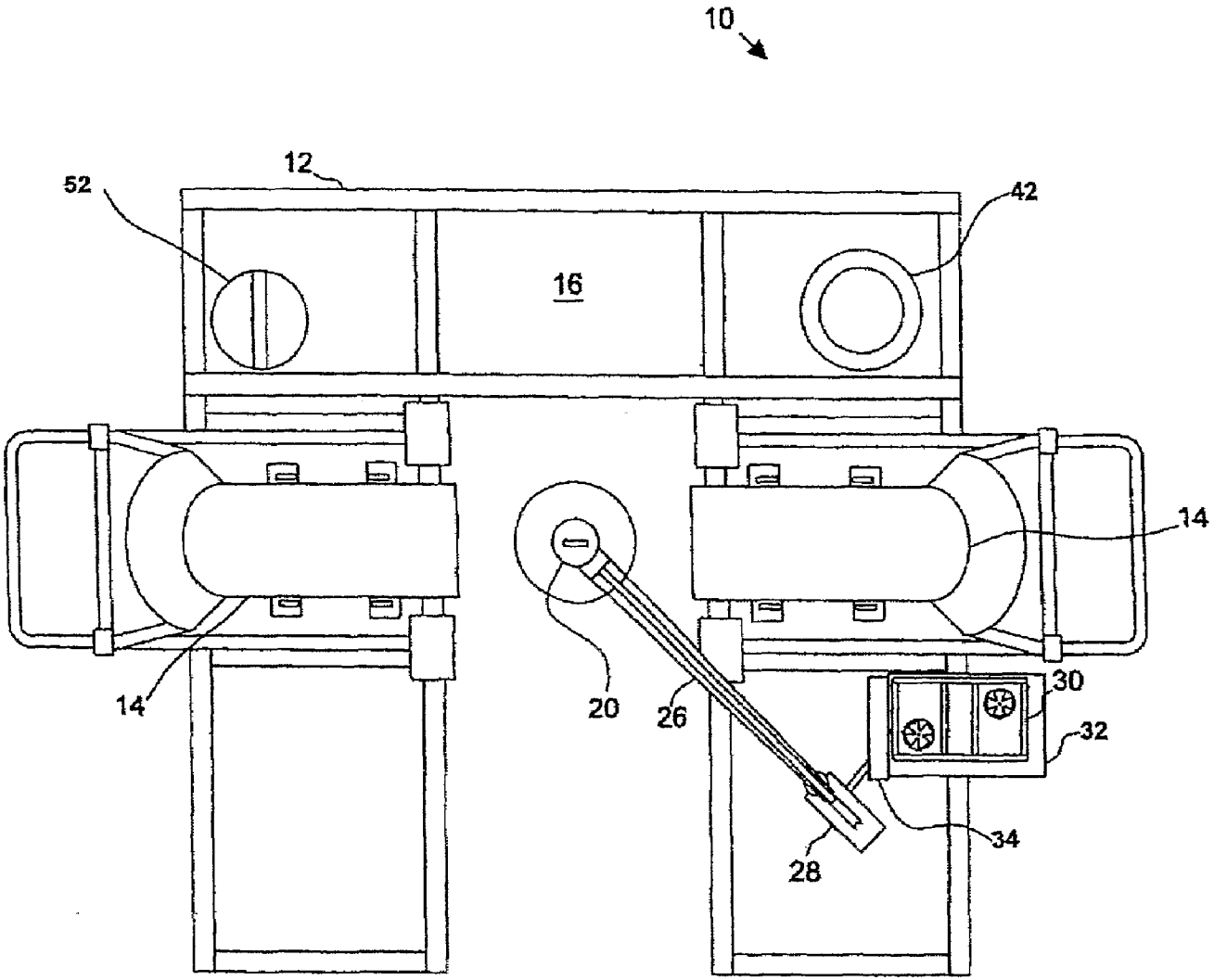
FIG. 4 is a plan view of the apparatus of FIG. 1 when the pile has been driven into the substrate.
Figure 5:
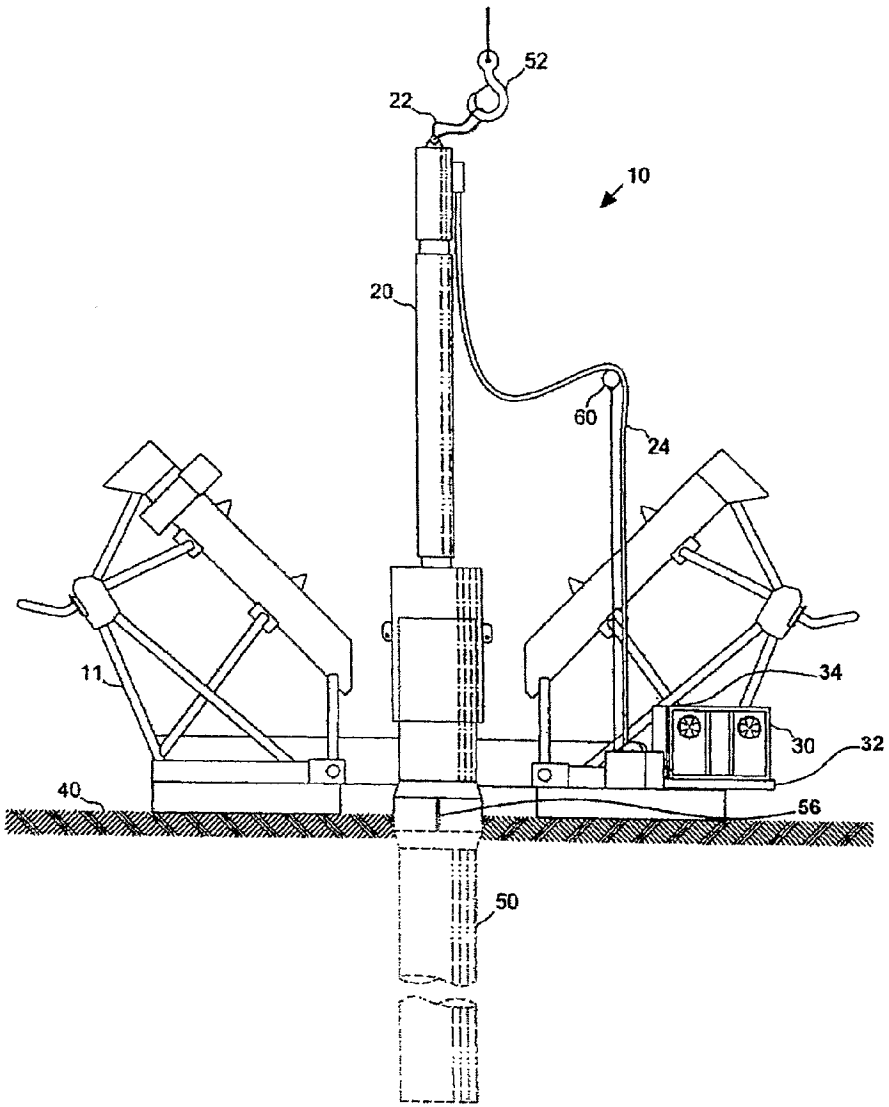
FIG. 5 is a side elevation of alternative apparatus embodying the present invention (shown with a pile already driven into a substrate)

FIG. 5 shows a similar arrangement to that of FIGS. 1-4, except that a flotation device (60) is employed instead of spooling device (28) to keep hose (24) out of harms way during pile driving.

Figure 6:
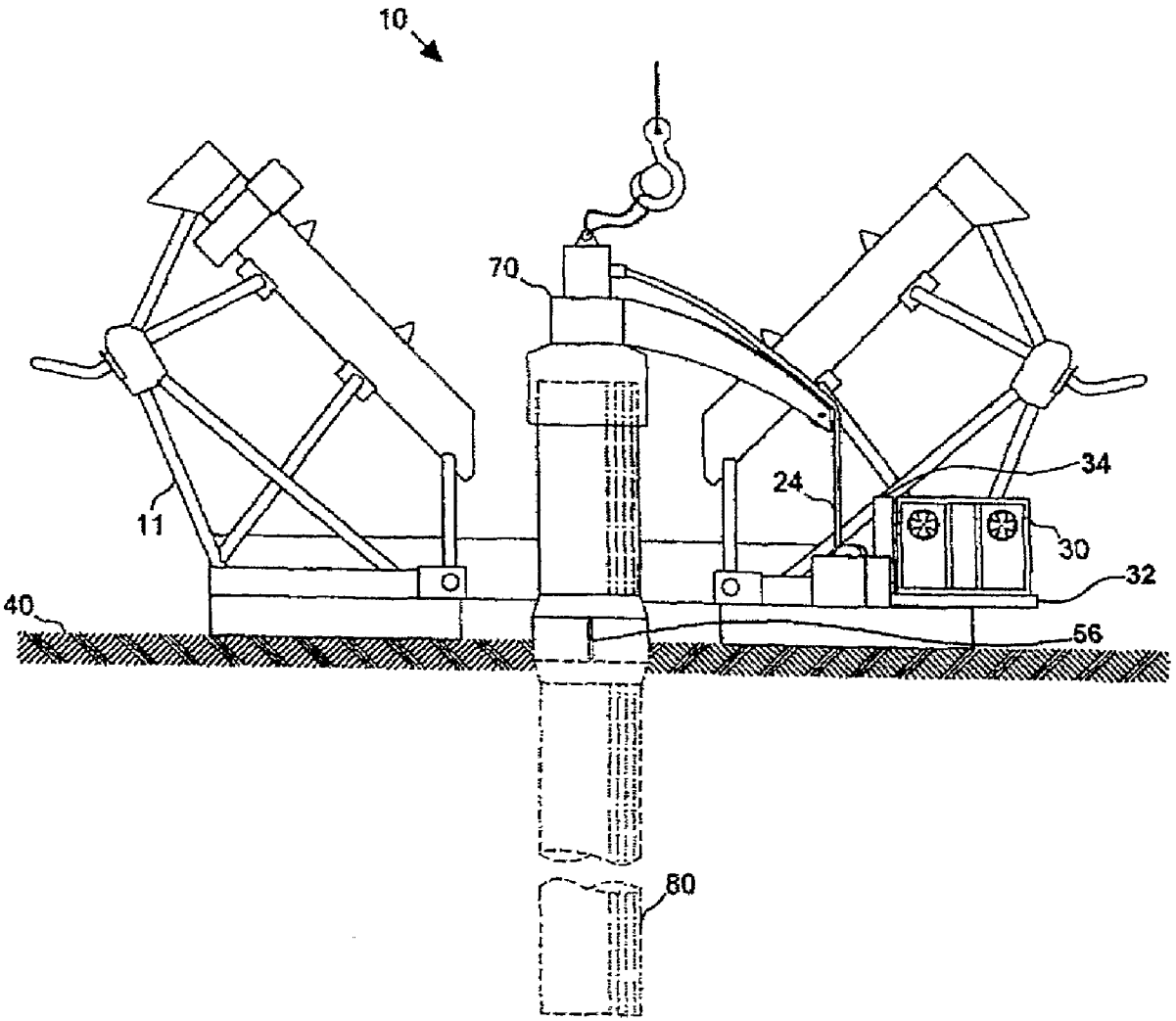
FIG. 6 is a side elevation of another apparatus embodying the present invention (again shown with a pile already driven into a substrate)

FIG. 6 shows a similar arrangement to that of FIGS. 1-4, except that hydraulic hammer (20) is replaced by a suction pump (70) and pile (50) is replaced by a suction pile or caisson (80). The suction pump (70) is used to remove trapped water inside the suction pile (80), with the resulting pressure differential between the external hydrostatic water pressure and the fluid inside the pile generating the driving force for pile penetration.

The invention claimed is:

1. Apparatus for driving a pile into an underwater substrate, comprising:

a pile guide comprising a base frame and a guide member mounted on the base frame, the guide member being configured to guide a pile as it is driven into a substrate when the base frame is resting thereon;

a device for driving a pile into a substrate; and a power supply for supplying power to drive the device;

wherein that the base frame of the pile guide defines a platform configured to carry the device and power supply when the pile guide is being moved into position for pile driving.

2. Apparatus according to claim 1, in which the device is a hydraulic hammer for driving piles into the substrate through repeated impacts.

3. Apparatus according to claim 1, in which the device is a suction pump for driving suction piles or caissons into the substrate through a pressure differential.

4. Apparatus according to claim 1, in which the platform may include a mount for supporting the device when coupled thereto.

5. Apparatus according to claim 4, in which the mount is configured to support the device in a predetermined orientation when coupled thereto.

6. Apparatus according to claim 1, in which the power supply is configured to supply mechanical or electrical power.

7. Apparatus according to claim 1, in which the power supply is configured to supply hydraulic power direct to the device.

8. Apparatus according to claim 7, further comprising a hose for supplying hydraulic power from the power supply to the device during pile driving.

9. Apparatus according to claim 8, in which the device includes a protuberant arm for guiding the hose to one lateral side of the device.

10. Apparatus according to claim 1, in which the power supply is part of a remotely operated vehicle, or a work remotely operated vehicle, detachably mounted on the platform of the pile guide.

11. Apparatus according to claim 10, in which the remotely operated vehicle, when mounted on the platform, is configured to provide thrust for control of pile guide orientation during deployment.

12. Apparatus according to claim 10, in which the platform of the pile guide includes a docking station for repeated attachment/detachment of the remotely operated vehicle thereto.

13. Apparatus according to claim 12, in which the docking station has an interface panel configured to receive power from the remotely operated vehicle when attached to the docking station.

14. Apparatus according to claim 13, in which the remotely operated vehicle and interface panel include mating connectors for communication between the power supply and the interface panel.

15. Apparatus according to claim 14, in which the connectors matingly engage automatically as the remotely operated vehicle attaches to the docking station.

16. A method of driving a pile into an underwater substrate, comprising:

providing apparatus comprising: a pile guide comprising a base frame and a guide member mounted on the base frame, the guide member being configured to guide a pile as it is driven into a substrate when the base frame is resting thereon;

a device for driving a pile into a substrate; and a power supply for supplying power to drive the device, with the base frame of the pile guide defining a platform configured to carry the device and power supply when the pile guide is being moved into position for pile driving;

positioning the apparatus on the substrate;

positioning a pile in the pile guide member;

moving the device from the platform of the base frame to engage the pile; and driving the pile into the substrate by using the power supply to power the device.

17. A method according to claim 16, further comprising storing the driving device on the platform of the base frame after the pile has been driven into the substrate and before a new pile is driven into the substrate.

18. A method according to claim 16, in which the device has a rest position on the platform of the base frame and an operational position on a pile in the pile guide member, with the method further comprising moving the device between its rest position and its operational position by a crane above water level.

19. A method according to claim 18, further comprising using the crane to raise and lower the pile guide and to position the pile in the pile guide member.

20. A method according to claim 16, in which the device is one of a hydraulic hammer and a suction pump, with the piles respectively being one of regular piles and suction piles.

21. A method according to claim 16, in which the power supply is part of a remotely operated vehicle or a work remotely operated vehicle detachably mounted on the platform of the pile guide.

22. A method according to claim 21, further comprising detaching the remotely operated vehicle from the platform of the base frame to perform a task associated with pile driving.

23. A method according to claim 22, in which the task is selected from the group consisting of: inspecting the pile in the pile guide member; releasing fastenings attaching the device to the base frame; coupling the device to lifting means; inspecting engagement between the device and the pile; inspecting the pile once driven into the substrate; and coupling the pile guide to lifting means.

24. A method according to claim 22, in which the platform of the base frame includes a docking station for re-attachment of the remotely operated vehicle to the platform once the or each task is completed.

25. A method according to claim 24, in which the docking station has an interface panel configured to receive power from the remotely operated vehicle when attached to the docking station.

26. A method according to claim 25, in which the remotely operated vehicle and interface panel includes mating connectors for communication of power from the former to the latter.

27. A method according to claim 24, further comprising establishing mating engagement of the connectors by re-attaching the remotely operated vehicle to the platform via the docking station.

28. A method according to claim 21, further comprising using the remotely operated vehicle to provide thrust for control of pile guide orientation and position during deployment.

29. A method according to claim 16, further comprise controlling orientation of the device relative to the pile in the pile guide member when engaging the pile.

* * * * *